US009621977B2

(12) United States Patent
Hu

(10) Patent No.: US 9,621,977 B2
(45) Date of Patent: Apr. 11, 2017

(54) EARPHONE

(75) Inventor: Zongbao Hu, WeiFang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 14/371,715

(22) PCT Filed: Sep. 11, 2012

(86) PCT No.: PCT/CN2012/081262

§ 371 (c)(1),
(2), (4) Date: Sep. 11, 2014

(87) PCT Pub. No.: WO2013/104195

PCT Pub. Date: Jul. 18, 2013

(65) Prior Publication Data

US 2015/0237437 A1 Aug. 20, 2015

(30) Foreign Application Priority Data

Jan. 10, 2012 (CN) ..... 2012 2 0008822 U

(51) Int. Cl.
*H04R 25/00* (2006.01)
*H04R 1/10* (2006.01)
*H04R 1/28* (2006.01)

(52) U.S. Cl.
CPC ..... *H04R 1/1058* (2013.01); *H04R 1/1016* (2013.01); *H04R 1/2826* (2013.01); *H04R 1/2849* (2013.01)

(58) Field of Classification Search
CPC .. H04R 1/1016; H04R 1/1033; H04R 1/1075; H04R 1/2811; H04R 1/2826; H04R 1/2849
See application file for complete search history.

(56) References Cited

U.S. PATENT DOCUMENTS 4,742,887 A * 5/1988 Yamagishi ..... H04R 1/2857 181/129
4,852,177 A * 7/1989 Ambrose ..... H04R 1/1016 181/135

(Continued)

FOREIGN PATENT DOCUMENTS

CN 102075827 A 5/2011
CN 102300139 A * 12/2011
CN 202310035 U 7/2012

OTHER PUBLICATIONS

International Search Report for PCT/CN2012/081262 filed on Sep. 11, 2012.

*Primary Examiner* — Curtis Kuntz
*Assistant Examiner* — Ryan Robinson

(57) ABSTRACT

The present invention provides an earphone including a speaker unit, a rear cavity of the earphone, an audio signal wire and an extension tube which connects to the rear cavity of the earphone and accommodates the audio signal wire. The earphone also includes a sound guide tube which is located in the extension tube and extends in the same direction as the extension tube and connects the rear cavity of the earphone with the exterior space of the earphone. The audio signal wire is separate from the sound guide tube. The earphone of this structure can improve the low frequency characteristics of the earphone effectively and upgrade the low frequency sound effect of the earphone.

5 Claims, 3 Drawing Sheets

(56) References Cited

U.S. PATENT DOCUMENTS

| | | | | |
|---|---|---|---|---|
| 5,115,473 | A * | 5/1992 | Yamagishi | H04R 1/2819<br>181/156 |
| 5,949,896 | A * | 9/1999 | Nageno | H04R 1/1016<br>381/380 |
| 8,055,007 | B2 * | 11/2011 | Kim | H04R 1/1041<br>381/372 |
| 8,467,561 | B2 * | 6/2013 | Tung | H04R 1/1041<br>381/373 |
| 8,532,325 | B2 * | 9/2013 | Tung | H04R 1/2811<br>381/338 |
| 8,971,561 | B2 * | 3/2015 | Howes | H04R 1/1016<br>381/370 |
| 8,989,425 | B2 * | 3/2015 | Hua | H04R 1/2803<br>381/370 |
| 2002/0181727 | A1 | 12/2002 | Shen et al. | |
| 2009/0147981 | A1 * | 6/2009 | Blanchard | H04R 1/1075<br>381/380 |
| 2012/0076341 | A1 * | 3/2012 | Ozawa | H04R 1/345<br>381/380 |
| 2014/0301591 | A1 * | 10/2014 | Yang | H04R 1/1016<br>381/380 |

* cited by examiner

EARPHONE

TECHNICAL FIELD

The present invention relates to an earphone, specifically to an earphone capable of improving low frequency characteristics.

BACKGROUND

Mid-end and high-end earphones with functions of voice communication and music-playing (or music-playing only) are widely used, which not only brings convenience to voice communication, but also the enjoyment of high-quality music provided by music software. Thus, the earphones are demanded by the user which can not only achieve excellent voice communication, but also present various kinds of life-like and vivid audio effects. Non-closed-type earphones are focused by more and more manufacturers and customers, with its small size, good portability, good cost performance and adaptability to the main equipment. Due to the restraint of small size of the earphone, the size of the speaker used therewith is also limited to this. The diameter of the speaker unit is usually between 6 mm and 18 mm, and the low-frequency effect of the earphone is limited by the small size of the speaker, so the earphone manufactures are actively making efforts to improve the low-frequency performance of the earphone. However, most of the manufacturers still focus on improving the low-frequency response of the speaker and the progress that has been made is limited.

SUMMARY

In view of the above technical problems, the present invention provides an earphone which is capable of enhancing the low frequency characteristics of the earphone by modifying the cavity structure of the earphone, thereby significantly improving the low frequency performance of the earphone and thus the low-frequency sound effect of the earphone.

In order to achieve the above goal, the present invention provides an earphone including a speaker unit, a rear cavity of the earphone, an audio signal wire and an extension tube which connects to the rear cavity of the earphone and accommodates the audio signal wire. The earphone also includes a sound guide tube which is located in the extension tube and extends in the same direction as the extension tube and connects the rear cavity of the earphone with the exterior space of the earphone. The audio signal wire is separate from the sound guide tube.

Furthermore, it is preferable that damping material is provided inside the sound guide tube.

Furthermore, it is preferable that the passage inside the sound guide tube is of an zigzag-shaped structure.

Furthermore, it is preferable that the length of the sound guide tube ranges from 1 mm to 80 mm.

Furthermore, it is preferable that the earphone also includes a positioning tube for accommodating and fixing the audio signal wire and the positioning tube is integrally formed on the extension tube.

Furthermore, it is preferable that the positioning tube is formed by the tube wall of the extension tube and an inner wall extending inwardly from the tube wall.

Furthermore, it is preferable that the sound guide tube is formed by the space inside the extension tube except for the positioning tube.

Furthermore, it is preferable that the earphone also includes a rear housing on which a plurality of air holes are arranged, and the extension tube is connected with the rear housing of the earphone.

Furthermore, it is preferable that a damping screen is arranged at the air holes.

With the above technical solution, comparing to a conventional structure, the earphone according to the present invention is provided with a sound guide tube connecting the rear cavity of the earphone with exterior space of the earphone, and the audio signal wire is separated from the sound guide tube, thus the low frequency characteristics of the earphone can be improved effectively and the low frequency sound effect of the earphone can be upgraded.

BRIEF DESCRIPTION OF DRAWINGS

With reference to the description illustrated with the accompanying drawings and the claims, other goals and achievements will become more comprehensible and easily understood with a more complete understanding of the present invention. In the drawings:

Throughout all the drawings, similar reference signs indicate similar or corresponding features or functions.

DETAILED DESCRIPTION OF THE EMBODIMENTS

For the purpose of illustration, various specific details are set forth in the following description to provide a more complete understanding for one or more embodiments of the invention. However, it is obvious that these embodiments may also be implemented without such specific details. In other examples, known structures and devices are illustrated in block diagrams to facilitate describing one or more embodiments.

Figure 1:
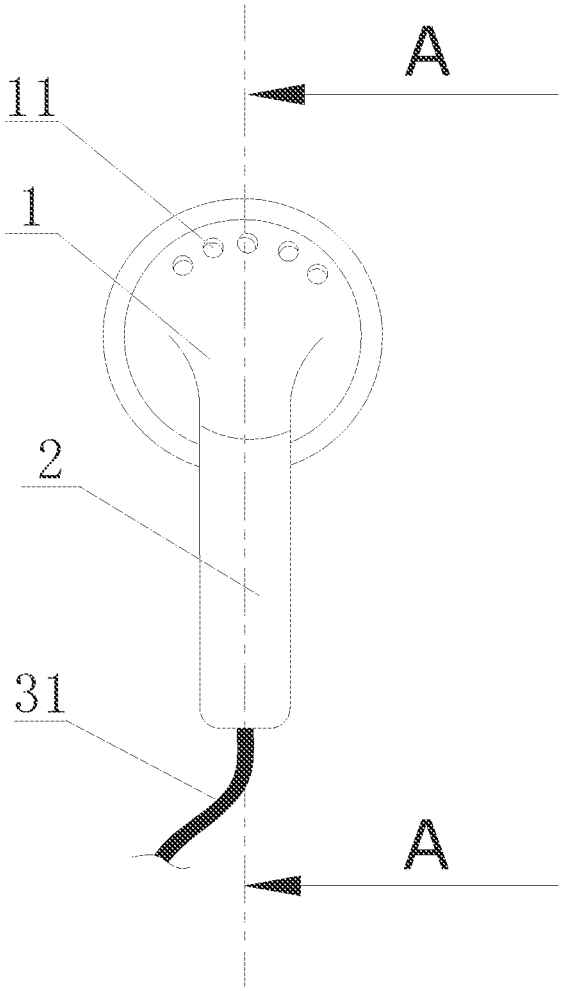
FIG. 1 is structural schematic illustrating the earphone according to the present invention.
Figure 2:
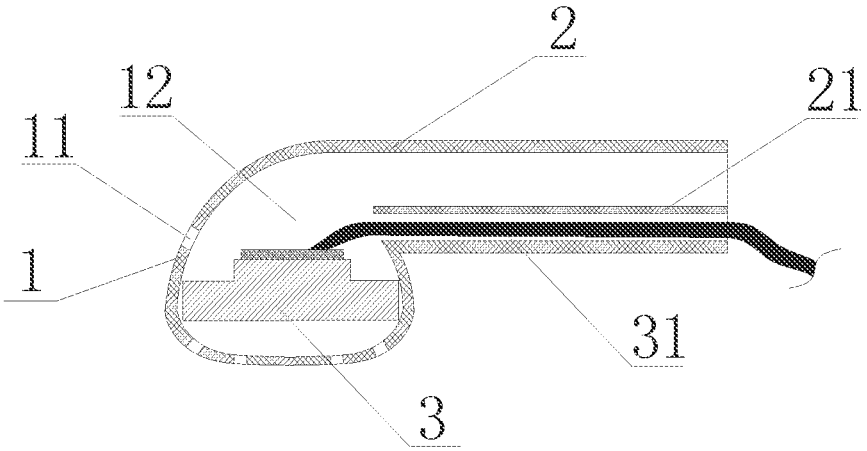
FIG. 2 is a sectional structural schematic taken along the A-A line of the earphone in FIG. 1.
Figure 3:
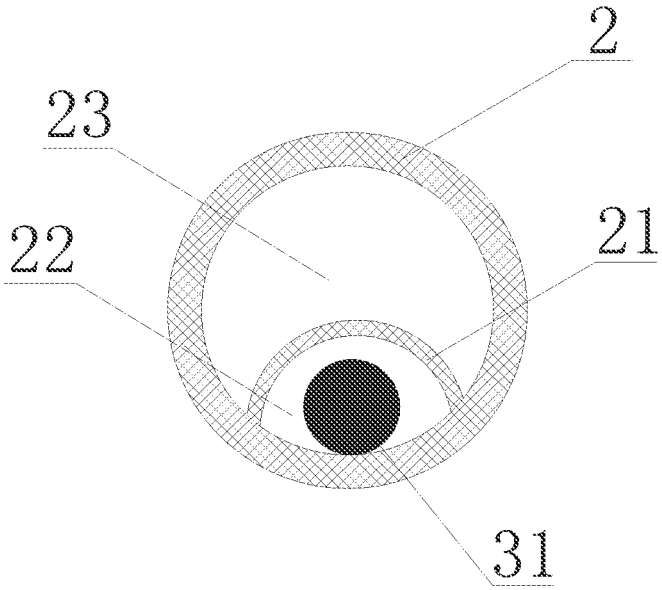
FIG. 3 is a sectional view of the extension tube of the earphone in FIG. 1.

As illustrated in FIG. 1 to FIG. 3, the earphone according to the present invention comprises a speaker unit 3, a rear housing 1 of the earphone accommodating the speaker unit 3 and an extension tube 2 connected with the rear housing 1, wherein, a rear cavity 12 of the earphone is formed between the speaker unit 3 and the rear housing 1, an audio signal wire 31 is electrically connected with the speaker unit 3, and the audio signal wire 31 is accommodated and fixed by the extension tube 2. Air holes 11 are provided on the rear housing 1, which connects the rear cavity 12 with the exterior space of the earphone thereby maintaining the sound pressure in the earphone constant.

In addition, the earphone according to the present invention is provided with a sound guide tube 23 connecting the rear cavity 12 with the exterior space of the earphone, and the sound guide tube 23 extends in the same direction as the extension tube 2 and is formed by the tube wall of the extension tube 2. The audio signal wire 3 is designed as being separated from the sound guide tube 23, i.e., the audio signal wire 3 is accommodated and fixed by a positioning tube 22 which is defined by the extension tube 2 and an inner wall 21 formed integrally with the tube wall of the extension tube 2, and the sound guide tube 23 is constituted by the space inside the extension tube 2 except for the positioning tube 22. The sound guide tube 23 may be implemented to have a uniform structure. With such a structure, wherein the sound guide tube 23 connects the interior cavity of the earphone with the exterior space of the earphone, low frequency components of the earphone can be decreased. With such a structure of the earphone, on the basis of the original frequency response, on one hand, the frequencies of the low-frequency response may expand toward the low frequency domain for nearly a hundred hertz; on the other hand, the loudness of the low-frequency response can be raised by 3-15 dB. Thus, the low-frequency effect of the earphone is significantly improved, which can bring more vivid and lifelike music enjoyment to the user, and when the user is watching hi-fi video program or listening to music, vivid and lifelike low-frequency components can be strongly felt.

Furthermore, the internal space of the rear cavity 12 of the earphone is divided into two parts by the inner wall 21, one part is the positioning tube 22 for accommodating and fixing the audio signal wire 31, and the other part is the sound guide tube 23. With the design of separating the audio signal wire 31 and the sound guide tube 23, the stability of the performance of the whole earphone is guaranteed, and the deviation of the frequency response is decreased. In addition, the positioning member for positioning the audio signal wire 31 is not limited to such a structure as the positioning tube 22, and other designs such as tubular hard plastics or metal thin-wall may also be used so that the audio signal wire can be stably positioned in the extension tube 2, and these improvements won't affect the implementation of the earphone according to the present invention.

Figure 4:
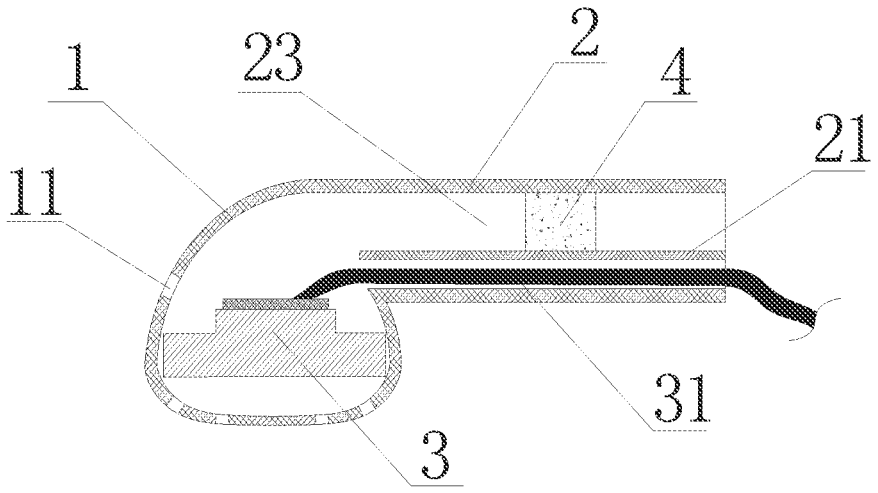
FIG. 4 shows an improved structure of the earphone according to the present invention.

FIG. 4 illustrates an improved structure of the earphone. The present implementation is different from the above implementation in that damping material 4 is provided inside the sound guide tube 23, which can further improve the low-frequency effects of the earphone, preferably, activated carbon materials having adsorptive capacity is used.

Figure 5:
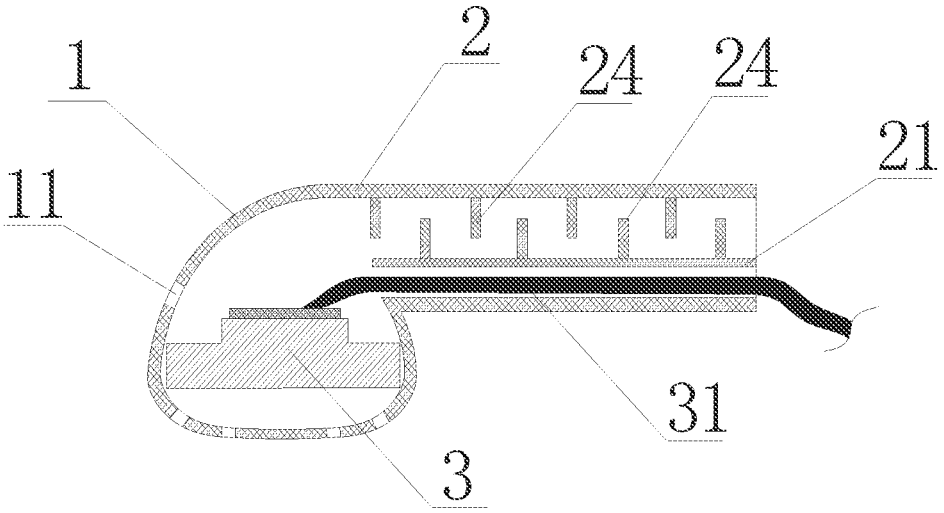
FIG. 5 shows another improved structure of the ear phone according to the present invention.

In addition, the sound guide tube 23 is not limited to a uniform tube. In FIG. 5, another improved structure of the earphone according to the present invention is illustrated, baffles 24 are provided on the sidewall of the extension tube 2 and parts of the inner wall 21 located in the sound guide tube 23, wherein the baffles 24 on the sidewall of the extension tube 2 are staggered from the baffles 24 on the inner wall 21, enabling the passage inside the sound guide tube 23 to be formed into a zigzag-shaped structure. This structure can also further improve the low frequency characteristics of the earphone and upgrade the low frequency sound effect of the earphone. The design of non-uniform tube is not limited to the structure of FIG. 5, and other improvements can be conceived and not detailed herein.

The length of the sound guide tube 23 according to the present invention ranges, preferably, from 1 mm to 80 mm, as the case may be.

Moreover, various improvements can be made to the earphone according to the present invention based on the above embodiments, for example, dustproof and sweat-proof damping screen can be disposed on the air holes, or the shape of the sound guide tube can be changed, or the sound guide tube can be configured as a separate member, and these improvements won't affect the implementation of the earphone of the present invention. Thus, it should be understood by those skilled in the art that various improvements can be made to the earphone of the present invention abovementioned without departing from the scope of the present invention which should be defined by the appended claims.

The invention claimed is:

1. An earphone including a speaker unit, a rear cavity of the earphone, an audio signal wire, and an extension tube which connects to the rear cavity and accommodates the audio signal wire, wherein, the earphone further includes a sound guide tube which is located in the extension tube and extends in the same direction as the extension tube and connects the rear cavity with the exterior space of the earphone; and the audio signal wire is separate from the sound guide tube, wherein the earphone further includes a positioning tube for accommodating and fixing the audio signal wire, the positioning tube is integrally formed with the extension tube, and the sound guide tube is defined by the space inside the extension tube except for the positioning tube, wherein the length of the sound guide tube ranges from 1 mm to 80 mm, wherein damping material is provided inside the sound guide tube, wherein the extension tube is connected with a rear housing of the earphone, wherein baffles are provided on a tube wall of the extension tube and an inner wall formed integrally with the tube wall of the extension tube, and wherein the baffles provided on the tube wall of the extension tube and the baffles provided on the inner wall are staggered with each other, so that a passage inside the sound guide tube is zigzag-shaped.

2. The earphone of claim 1, wherein the positioning tube is formed by the tube wall of the extension tube and the inner wall extended inwardly from the tube wall.

3. The earphone of claim 1, wherein the earphone includes the rear housing on which a plurality of air holes are disposed.

4. The earphone of claim 3, wherein a damping screen is disposed at the air holes.

5. The earphone of claim 1, wherein the sound guide tube is larger than the positioning tube.

* * * * *